US012089676B2

(12) United States Patent
Matsuura et al.

(10) Patent No.: US 12,089,676 B2
(45) Date of Patent: Sep. 17, 2024

(54) HAIR ATTACHMENT, HAIR ATTACHMENT UNIT, AND METHOD OF ATTACHING HAIR ATTACHMENT

(71) Applicant: KANEKA CORPORATION, Osaka (JP)

(72) Inventors: Yaeno Matsuura, Takasago (JP); Keiko Takechi, Takasago (JP); Wataru Mio, Takasago (JP)

(73) Assignee: KANEKA CORPORATION, Osaka (JP)

( * ) Notice: Subject to any disclaimer, the term of this patent is extended or adjusted under 35 U.S.C. 154(b) by 506 days.

(21) Appl. No.: 17/236,308

(22) Filed: Apr. 21, 2021

(65) Prior Publication Data

US 2021/0235800 A1 Aug. 5, 2021

Related U.S. Application Data

(63) Continuation of application No. PCT/JP2019/036818, filed on Sep. 19, 2019.

(30) Foreign Application Priority Data

Nov. 28, 2018 (JP) ..... 2018-221932

(51) Int. Cl.
*A41G 3/00* (2006.01)
*A41G 5/00* (2006.01)

(52) U.S. Cl.
CPC ..... *A41G 3/0083* (2013.01); *A41G 3/0041* (2013.01); *A41G 3/0075* (2013.01); *A41G 5/004* (2013.01); *A41G 3/005* (2013.01)

(58) Field of Classification Search
CPC ..... A41G 3/00; A41G 3/0008; A41G 3/0033; A41G 3/0041; A41G 3/005; A41G 3/0083;

(Continued)

(56) References Cited

U.S. PATENT DOCUMENTS 2,865,380 A * 12/1958 Mitchell ..... A41G 5/006 132/201
3,835,867 A * 9/1974 Molinario ..... A41G 3/0016 132/201

(Continued)

FOREIGN PATENT DOCUMENTS

JP H2-264006 A 10/1990
JP 2015-209624 A 11/2015

(Continued)

OTHER PUBLICATIONS

Jang, WO-2014073736 English Translation, May 2023, Description (Year: 2023).*

(Continued)

*Primary Examiner* — Jan Christopher L Merene
*Assistant Examiner* — Kylie M. Gaspar
(74) *Attorney, Agent, or Firm* — Osha Bergman Watanabe & Burton LLP

(57) ABSTRACT

Provided are an artificial hair and an artificial hair unit that are easier to attach to a head of a user, a wig cap, or the like, and a method for attaching the artificial hair. The present invention provides a configuration including at least two fiber groups and an attachment part having a plurality of annular parts. The two fiber groups spread at least in a first direction, where the attachment part extends in the first direction and is sandwiched between the two fiber groups and sewn onto the two fiber groups, and where the plurality of annular parts are exposed to an outside from between the two fiber groups.

15 Claims, 8 Drawing Sheets

(58) Field of Classification Search
CPC ..... A41G 3/0075; A41G 5/00; A41G 5/0006; A41G 5/0013; A41G 5/002; A41G 5/0026; A41G 5/0046; A41G 5/0053; A41G 5/006; A41G 5/0073; D10B 2503/08; D03D 1/00; D03D 27/00–06; D04C 1/06
See application file for complete search history.

(56) References Cited

U.S. PATENT DOCUMENTS 4,171,001 A * 10/1979 Leonard ..... A41G 3/0075 132/53
5,357,986 A * 10/1994 Hargrett ..... A41G 5/004 132/54
6,581,609 B2 * 6/2003 Ott ..... A41G 3/00 132/201
6,708,696 B2 * 3/2004 Ferguson ..... A41G 5/0073 132/201
9,107,460 B1 * 8/2015 Synn ..... A41G 3/0016
11,805,833 B1 * 11/2023 Vahos ..... A41G 5/0053
2004/0168696 A1 * 9/2004 Cox ..... A41G 3/0016 132/54
2007/0125399 A1 * 6/2007 Guliker ..... A41G 5/0066 132/201
2008/0276949 A1 * 11/2008 Lee ..... A41G 5/0066 132/53
2009/0241973 A1 * 10/2009 Hampton ..... A41G 3/0025 132/54
2011/0226274 A1 * 9/2011 Turner ..... A41G 5/006 132/201
2012/0067365 A1 * 3/2012 Brown ..... A41G 5/002 132/201
2012/0085362 A1 * 4/2012 Costa ..... A41G 5/004 132/201
2013/0098383 A1 * 4/2013 Winn ..... A41G 5/0073 132/201
2013/0306089 A1 * 11/2013 Araujo Costa ..... A41G 5/004 132/54
2014/0326267 A1 * 11/2014 Peterson ..... A41G 5/0046 132/201
2015/0013708 A1 * 1/2015 Chamberlain ..... A41G 3/005 132/54
2017/0095026 A1 * 4/2017 Chung ..... A41G 3/0041
2017/0273381 A1 * 9/2017 Tao ..... A41G 5/0046
2018/0035738 A1 2/2018 Hayes
2019/0216152 A1 * 7/2019 Francis ..... A41G 5/0073
2020/0337401 A1 * 10/2020 Lee ..... A41G 3/0041
2021/0227907 A1 * 7/2021 Takechi ..... A41G 3/0075
2023/0109742 A1 * 4/2023 Gray ..... A41G 5/0046 132/201
2023/0147011 A1 * 5/2023 Wang ..... A41G 5/0046 132/53
2023/0371632 A1 * 11/2023 Lee ..... A41G 5/004

FOREIGN PATENT DOCUMENTS

JP 6312514 B2 4/2018
WO WO-2014073736 A1 * 5/2014 ..... A41G 5/002

OTHER PUBLICATIONS

Office Action issued in corresponding Chinese Application No. 201980048154.9; dated Jul. 26, 2022 (15 pages).
International Preliminary Report on Patentability issued for PCT/JP2019/036818, issued May 25, 2021 (9 pages).
International Search Report issued in International Application No. PCT/JP2019/036818, mailed Nov. 5, 2019 (3 pages).
Written Opinion issued in International Application No. PCT/JP2019/036818, mailed Nov. 5, 2019 (6 pages).

* cited by examiner

HAIR ATTACHMENT, HAIR ATTACHMENT UNIT, AND METHOD OF ATTACHING HAIR ATTACHMENT

TECHNICAL FIELD

The present invention relates to artificial hair, an artificial hair unit, and a method for attaching artificial hair.

BACKGROUND

One conventional method for changing women's hairstyles is to attach weaving.

When attaching weaving, hair of a user is braided in cornrows, and hung-down-fiber (fiber group) are sewn onto this braided part. Weaving can be therefore attached in accordance with a size of the head of the user, without any concern about misalignment or detachment, allowing fine modifications of parting, weights, and the like.

Since there is only a slight gap in the braided (knitted) part of base hair in the case of attaching the hung-down-fiber, conventionally a sharp needle is used to thread the hung-down fiber itself. Then, the braided part is threaded with a sharp needle to attach the hung-down fiber to the braided part. In this case, the sharp needle is used, and the sharp needle may be mistakenly pierced into a scalp when threading through the braided part of the base hair.

Thus, in recent years, a jig dedicated to threading the braided (knitted) part of the base hair has been developed (for example, Patent Document 1).

PATENT DOCUMENTS

Patent Document 1: JP 6312514 B2

However, the jig in Patent Document 1, which has a large diameter at a distal end, is difficult to pass through generally-used hung-down-fiber. Further, when the hung-down-fiber itself is passed through the jig, a sharp needle is used, and the attachment of the hung-down-fiber to the braided part is troublesome.

SUMMARY

One or more embodiments of the present invention relate to providing artificial hair and an artificial hair unit that are easier to be attached to human hair, a wig cap, or the like than the known art, and a method for attaching the artificial hair.

One or more embodiments of the present invention relate to artificial hair including: at least two fiber groups; and an attachment part having a plurality of annular parts, wherein the two fiber groups spread in a first direction, wherein the attachment part extends in the first direction, wherein the attachment part is sandwiched between the two fiber groups and is sewn onto the two fiber groups, and wherein the annular part is exposed to outside from between the two fiber groups.

In one or more embodiments of the present invention, the annular parts are provided and exposed from the fiber groups, and thus the artificial hair can be attached to human hair of the head of the user, a wig cap, or the like by passing a thread or a string through the annular parts without passing a sharp needle, thereby allowing safe attachment of the artificial hair.

In one or more embodiments of the present invention, the attachment part is a braid or weaving.

In one or more embodiments of the present invention, the annular part has an opening, and the opening encloses a circle having a maximum diameter, the maximum diameter being 1.5 mm or more and 2 cm or less.

In one or more embodiments of the present invention, the annular part is in parallel to the first direction (predetermined direction) and has an opening facing a direction different from the first direction (predetermined direction).

In one or more embodiments of the present invention, the annular part includes a linear body, and the linear body has an arithmetic mean width of 0.5 mm or more and 3 mm or less.

In one or more embodiments of the present invention, the annular part includes a linear body and is stretchable in an extending direction.

In one or more embodiments of the present invention, the at least two fiber groups include a first fiber group and a second fiber group, the first fiber group and the second fiber group each have fiber bundles in which a plurality of fibers are bundled, and the fiber bundle of the first fiber group are located between the fiber bundles of the second fiber group in the first direction when viewed from a front.

In one or more embodiments of the present invention, the attachment part includes a plurality of linear bodies, and the attachment part is attached to the two fiber groups by direct sewing of the plurality of linear bodies onto the two fiber groups.

One or more embodiments of the present invention relate to artificial hair including: at least two fiber groups; and a first linear part, wherein the first linear part is sandwiched between the two fiber groups and is sewn onto the two fiber groups while meandering, wherein the first linear part has an exposed part that is exposed to outside from between the two fiber groups, and wherein the exposed part of the first linear part configures a plurality of annular parts together with the fiber groups.

In one or more embodiments of the present invention, the annul ar parts are configured by the first linear part, and thus an area of the opening of the annular parts can be increased, and the artificial hair can be easily attached to human hair, a wig cap, or the like by passing a thread or a string through the annular parts.

In one or more embodiments of the present invention, the first linear part includes: an external folded part that is folded outside the two fiber groups: an internal folded part that is folded inside the two fiber groups: a forward connecting part directed from the internal folded part toward the external folded part; and a return connecting part directed from the external folded part toward the internal folded part, and the artificial hair includes a gap closure disposed between the two fiber groups, the gap closure filling a gap between the forward connecting part and the return connecting part.

One or more embodiments include a second linear part extending inside and outside the two fiber groups, wherein the second linear part is partially disposed between the forward connecting part and the return connecting part outside the first linear part to be substantially flush with the forward connecting part and the return connecting part.

One or more embodiments include a second linear part extending inside and outside the two fiber groups, wherein the second linear part includes an exposed part that is exposed from the two fiber groups, the exposed part being outside the first linear part, the exposed part extending so as to surround the annular part.

One or embodiments of the present invention relate to an artificial hair unit including: a cap member: artificial hair; and an attachment string for attaching the artificial hair to the cap member, wherein the cap member includes a knitted part in which imitation hair is knitted, the cap member covering a part or all of a head of a user, wherein the artificial hair includes: at least two fiber groups; and an attachment part having a plurality of annular parts, wherein the two fiber groups spread in a first direction (predetermined direction), wherein the attachment part extends in the first direction, wherein the attachment part is sandwiched between the two fiber groups and is sewn onto the two fiber groups, wherein the annular part is exposed to outside from the two fiber groups, wherein the attachment string passes through the annular part and the knitted part, thereby attaching the plurality of annular parts to the knitted part, and wherein the attachment string is untied when pulled in the first direction (predetermined direction).

In one or more embodiments of the present invention, in order to attach the artificial hair to the cap member, for example, the artificial hair is attached to the cap member and then the cap member is fixed to the head of a operated person, such as hair that is set in cornrows, thereby allowing safer treatment.

In one or more embodiments of the present invention, when the attachment string is pulled in the first direction, the attachment string is untied and the artificial hair can be removed from the cap member. It is therefore possible to easily change the artificial hair.

In one or more embodiments of the present invention, the attachment string is stretchable in a longitudinal direction.

In one or more embodiments of the present invention, the attachment string is stretchable up to 1.1 times or more with no load applied.

One or more embodiments of the present invention relate to a method for attaching the artificial hair to a knitted part of a head of a user or a knitted part of a cap member by using an attachment string, wherein the plurality of annular parts includes a first annular part and a second annular part, the method including: arranging the attachment string along the knitted part; forming a first folded part by hooking an intermediate part of the attachment string with a jig, and passing the first folded part through a gap of the knitted part and then through the first annular part; and forming a second folded part that is different from the first folded part by hooking an intermediate part of the attachment string with the jig, and passing the second folded part through a gap of the knitted part, through the second annular part, and then through the first folded part.

The "intermediate part" here is a part that is other than an end and is between opposite ends.

In one or more embodiments of the present invention, the first annular part and the second annular part are adjacent to each other in the first direction.

The artificial hair of one or more embodiments of the present invention facilitates attachment to the head of the user, a wig cap, or the like as compared with the known art.

The artificial hair unit of one or more embodiments of the present invention facilitates attachment to the cap member as compared with the known art.

DETAILED DESCRIPTION OF THE EMBODIMENTS

Hereinafter, one or more embodiments of the present invention will be described in detail.

Figure 1:
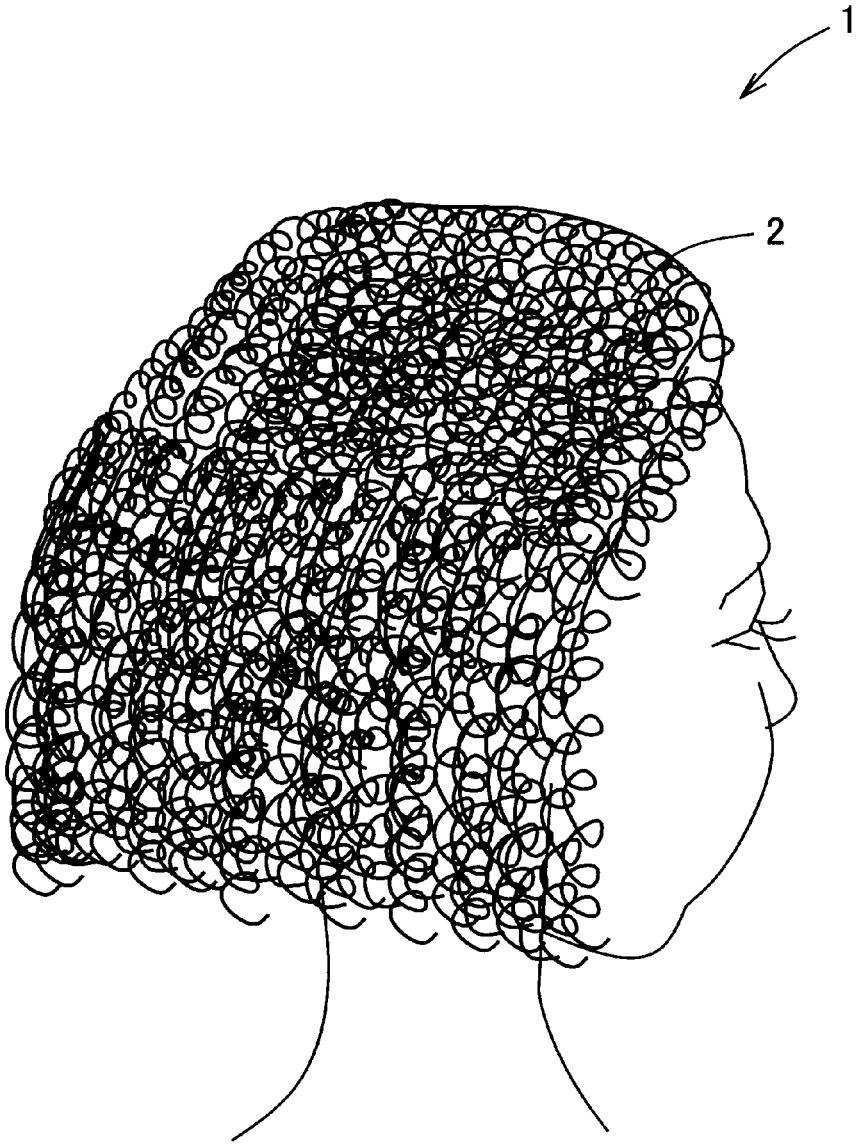
FIG. 1 is a perspective view schematically showing how an artificial hair unit according to one or more embodiments of the present invention is used.
Figure 2:
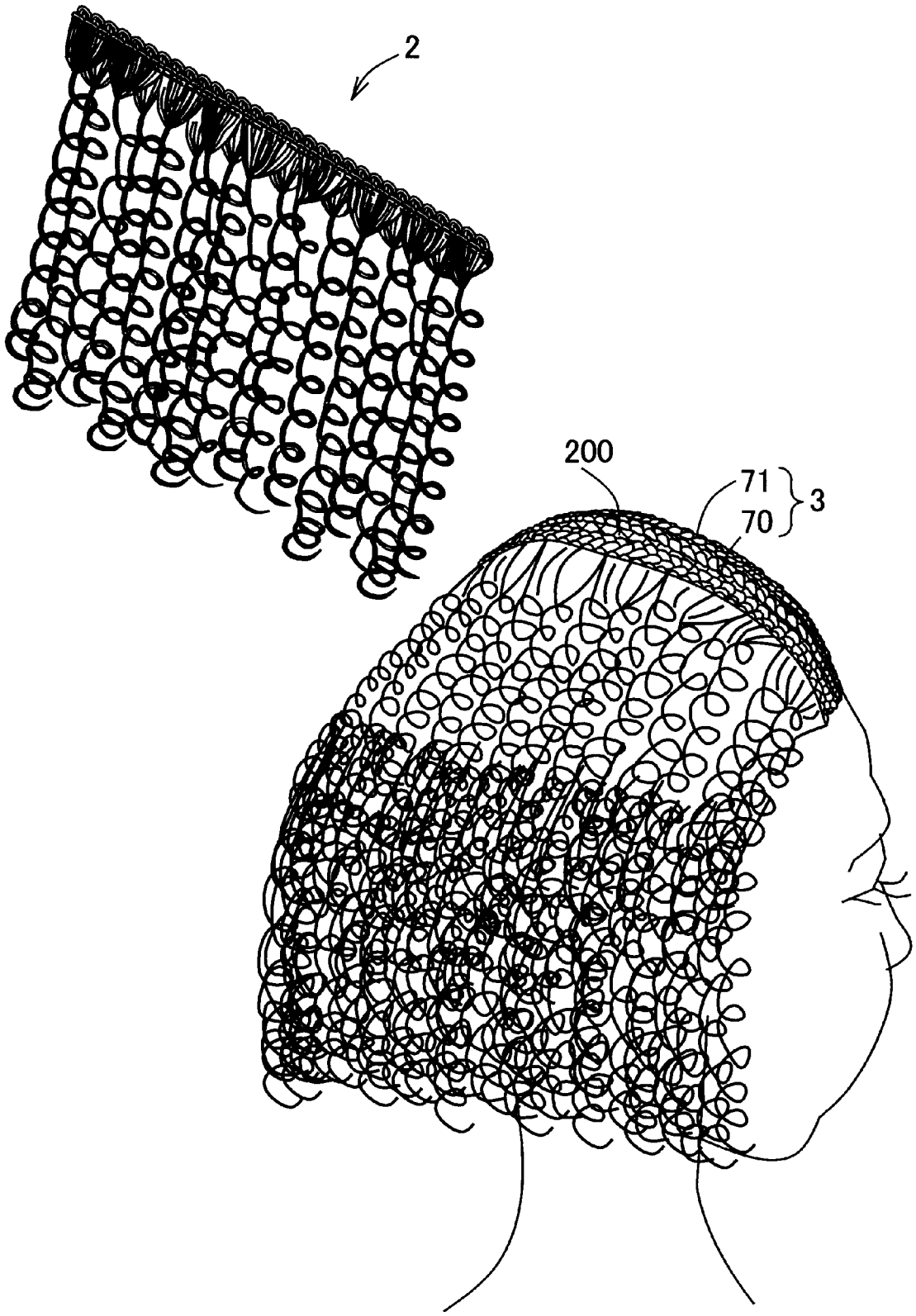
FIG. 2 is an exploded perspective view of the artificial hair unit in FIG. 1.

As shown in FIGS. 1 and 2, an artificial hair unit 1 according to one or more embodiments of the present invention is to be attached to a head 200 of a user. In the artificial hair unit 1, artificial hair 2 is attached to the head 200 of the user with a cap member 3.

Figure 6:
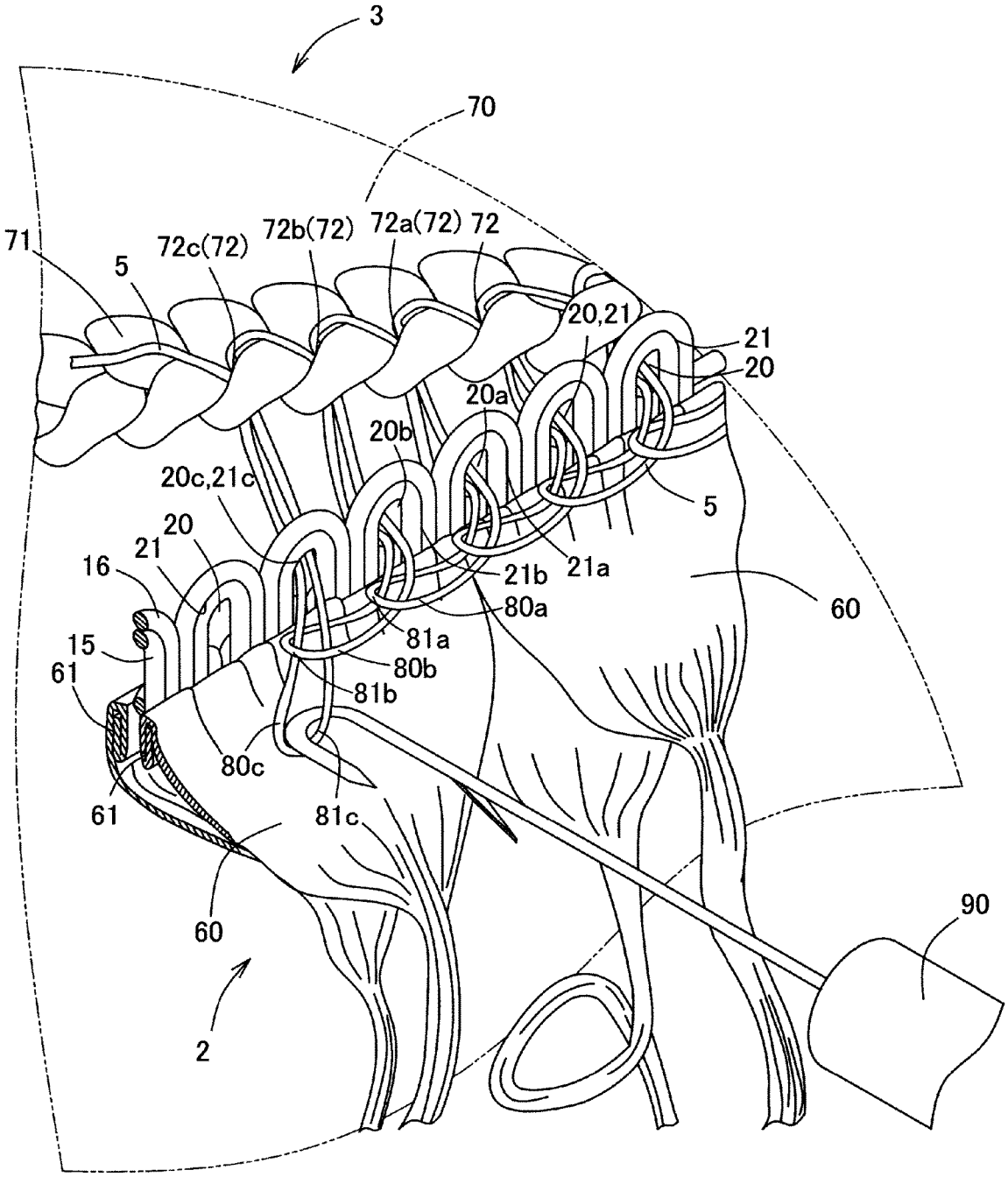
FIG. 6 is a perspective view showing a state in which the artificial hair in FIG. 1 is being attached to a cap member.

As shown in FIG. 2, the artificial hair unit 1 includes the artificial hair 2, the cap member 3, and an attachment string 5 (see FIG. 6).

Figure 3:
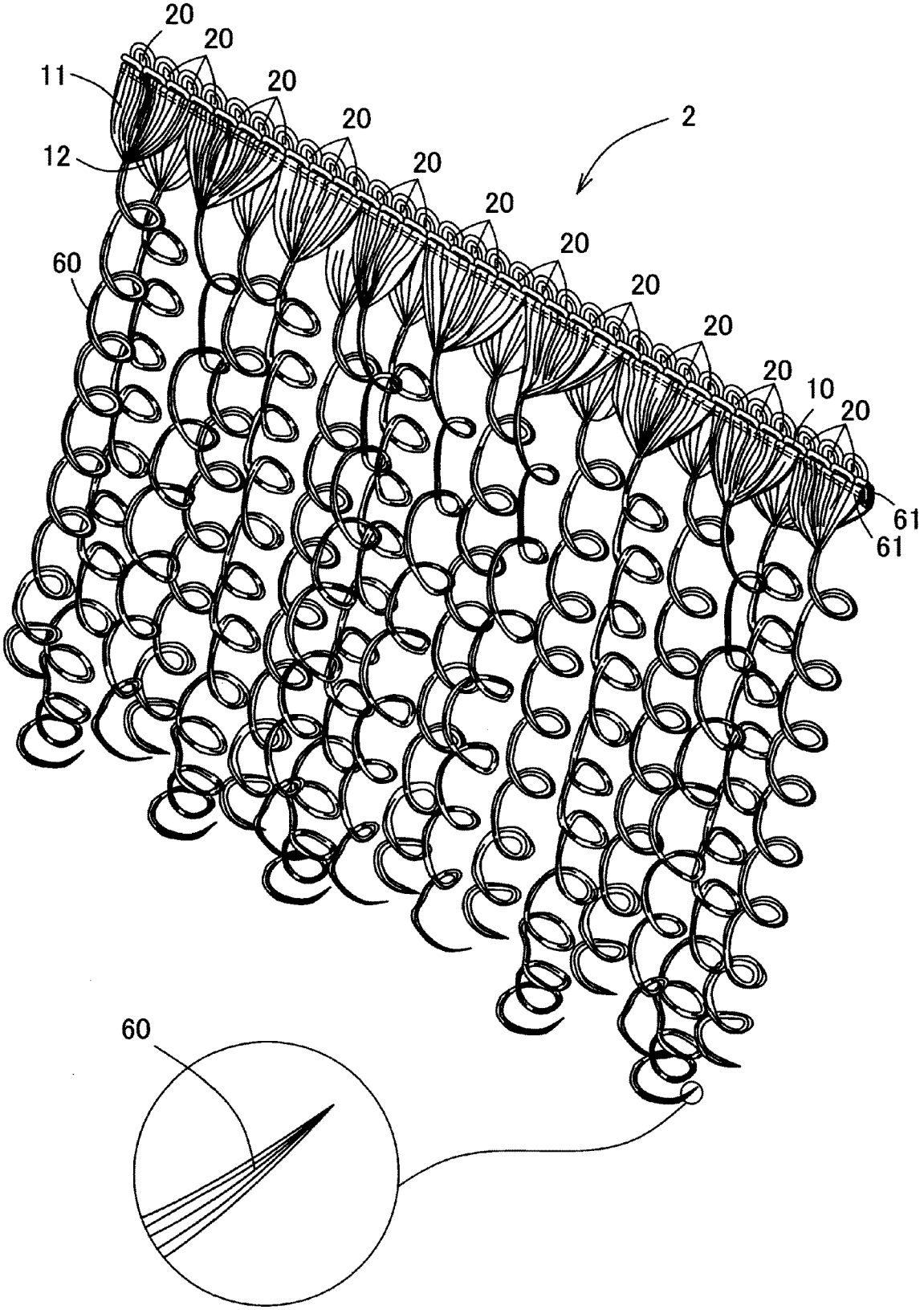
FIG. 3 is a perspective view of artificial hair in FIG. 1.
Figure 4:
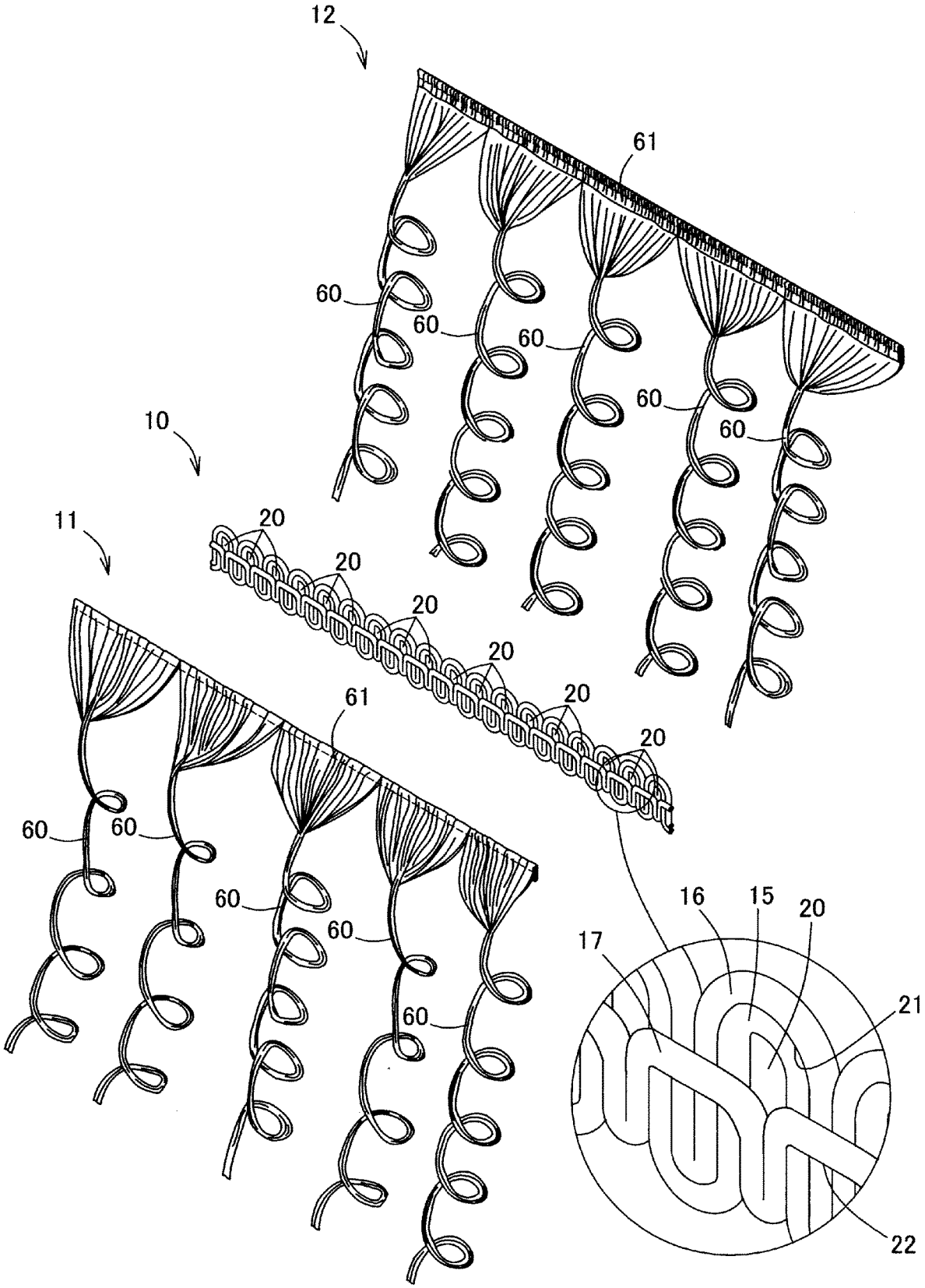
FIG. 4 is an exploded perspective view of a part of the artificial hair in FIG. 1.

As shown in FIGS. 3 and 4, the artificial hair 2 mainly includes an attachment part 10 and fiber groups 11 and 12.

The attachment part 10 is a so-called braid or weaving, and has a plurality of annular parts 20.

Figure 5:
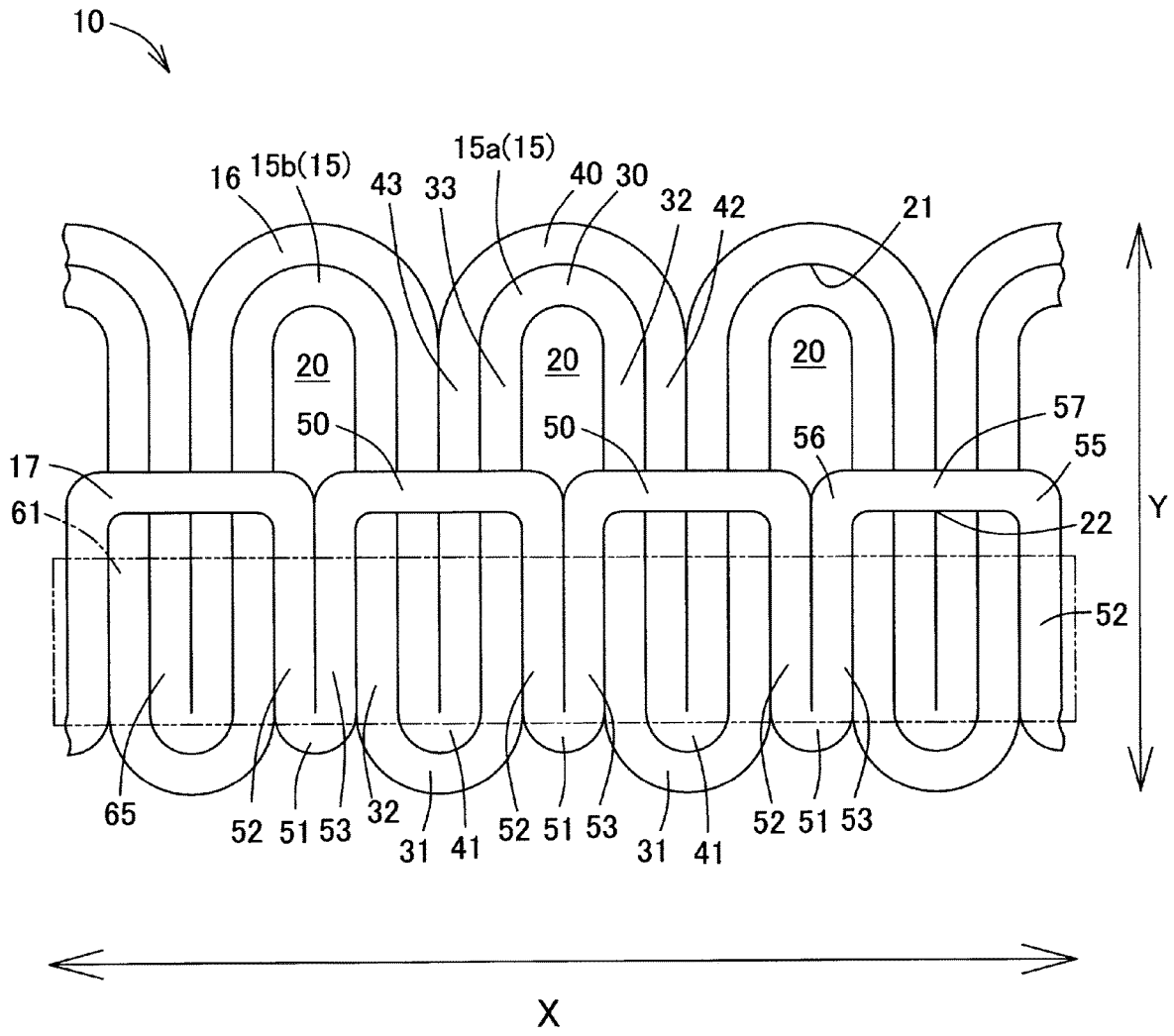
FIG. 5 is a plan view of an attachment part in FIG. 4.

In the attachment part 10, according to one or more embodiments, a first linear part 15, a second linear part 16, and a third linear part 17 are sewn as shown in FIG. 5, and the annular parts 20 are formed by the first linear part 15.

The first linear part 15 is a linear body meandering in a vertical direction (longitudinal direction Y, second direction). The first linear part 15 includes an upper folded part 30, a lower folded part 31, a forward connecting part 32 extending linearly from the lower folded part 31 toward the upper folded part 30, and a return connecting part 33 extending linearly from the upper folded part 30 toward the lower folded part 31.

The upper folded part 30 is folded back in an arc shape from the forward connecting part 32 toward the returning connecting part 33, and configures each annular part 20 together with a first fiber group 11 and a second fiber group 12.

An arithmetic mean width of the first linear part 15 is preferably 0.5 mm or more and 3 mm or less.

Within this range, the first linear part 15 is inconspicuous while ensuring sufficient strength.

A maximum diameter of a circle enclosed by an opening of each annular part 20 is preferably 1.5 mm or more and 2 cm or less.

Within this range, the attachment string 5 can be easily passed through and the opening is inconspicuous.

The lower folded part 31 is a part that is folded back in an arc shape from the return connecting part 33 toward the forward connecting part 32.

Each annular part 20 is stretchable in an extending direction, and its length is preferably stretchable to 1.05 times or more with no load applied. That is, a diameter of the opening of each annular part 20 is preferably expandable.

The second linear part 16 is a linear body meandering in the vertical direction similarly to the first linear part 15. The second linear part 16 includes an upper folded part 40, a lower folded part 41, a forward connecting part 42 extending linearly from the lower folded part 41 toward the upper folded part 40, and a return connecting part 43 extending linearly from the upper folded part 40 toward the lower folded part 41.

The second linear part 16 is located entirely above the first linear part 15, and extends while maintaining substantially parallel. That is, in the second linear part 16, the upper folded part 40 is folded back in an arc shape, and the second linear part 16 extends so as to surround each annular part 20 from outside the first linear part 15 when viewed from a front. The upper folded part 40 configures an annular part 21 together with the first fiber group 11 and the second fiber group 12.

As shown in FIG. 5, the third linear part 17 is a linear body meandering in the vertical direction similarly to the first linear part 15. The third linear part 17 includes an upper folded part 50, a lower folded part 51, a forward connecting part 52 extending linearly from the lower folded part 51 toward the upper folded part 50, and a return connecting part 53 extending linearly from the upper folded part 50 toward the lower folded part 51.

The upper folded part 50 includes two bent parts 55 and 56 and a connecting part 57 connecting the bent parts 55 and 56. That is, the upper folded part 50 is connected to the return connecting part 53 from the forward connecting part 52 via the bent part 55, the connecting part 57, and the bent part 56. The upper folded part 50 configures an annular part 22 together with the first fiber group 11 and the second fiber group 12.

As shown in FIG. 4, the fiber groups 11 and 12 spread at least in a lateral direction X (predetermined direction, first direction). Specifically, the fiber groups 11 and 12 are hung-down-fibers including a fiber bundle 60 in which a plurality of fibers are bundled and a connecting part 61.

The fiber bundle 60 is fibers that imitate hair and includes bendable linear fibers.

Examples of fibers configuring the fiber bundle 60 include flame-retardant fibers such as collagen protein fibers, vinyl chloride fibers, vinylidene chloride fibers, acrylic fibers, and flame-retardant polyester fibers, and natural hair such as human hair and animal hair. In particular, as the fibers configuring the fiber bundle 60, KANEKARON® (registered trademark) manufactured by KANEKA CORPORATION can be favorably used for its self-extinguishing property, unlikeliness to cause melting and drip, and excellent dyeability and color developing property.

A part around one end of the fiber bundle 60 is folded back a plurality of times and sewn together with the other fiber bundles 60, and this folded part configures the connecting part 61.

The connecting part 61 is a part connecting each fiber bundle 60, and spreads in a plane shape.

Here, a positional relationship of each part of the artificial hair 2 will be described.

As will be described later, the attachment part 10 is partially sandwiched between the fiber groups 11 and 12 and sewn. Specifically, each of the linear parts 15 to 17 is sandwiched between the fiber groups 11 and 12, and is directly sewn and attached thereto.

The first fiber group 11 partially overlaps with the second fiber group 12 when viewed from a front. The fiber bundle 60 of the first fiber group 11 is located between the adjacent fiber bundles 60 and 60 of the second fiber group 12.

As shown in FIG. 5, the annular parts 20 to 22 are disposed side by side in the lateral direction X at an equal interval such that openings face in a thickness direction.

The linear parts 15 to 17 extend in and out in the longitudinal direction Y from between the fiber groups 11 and 12, and a part of the annular parts 20 to 22 is exposed to outside from the fiber groups 11 and 12. It can be said that the upper folded parts 30, 40, and 50 are external folded parts that are folded outside the fiber groups 11 and 12, and the lower folded part 31, 41, and 51 are internal folded parts that are folded inside the fiber groups 11 and 12.

The linear parts 15 to 17 overlap in the lateral direction X with substantially no gap between the first fiber group 11 and the second fiber group 12.

Specifically, as shown in FIG. 5, the forward connecting part 42 and the return connecting part 43 of the second linear part 16 are located between the forward connecting part 32 of a first linear part 15*b* and the return connecting part 33 of a first linear part 15*a* adjacent to the first linear part 15*b*. That is, the forward connecting part 42 and the return connecting part 43 of the second linear part 16 fill a gap between the forward connecting part 32 of the first linear part 15*b* and the return connecting part 33 of the first linear part 15*a* adjacent to the first linear part 15*b*.

The forward connecting part 52 and the return connecting part 53 of the third linear part 17 are located between the return connecting part 33 of the first linear part 15*a* and the forward connecting part 32 of the first linear part 15*a*. That is, the forward connecting part 52 and the return connecting part 53 of the third linear part 17 fill a gap between the return connecting part 33 of the first linear part 15*a* and the forward connecting part 32 of the first linear part 15*a*.

From another point of view, the forward connecting part 42 and the return connecting part 43 of the second linear part 16 function as gap closures that fill the gap between the forward connecting part 32 of the first linear part 15*b* and the return connecting part 33 of the first linear part 15*a* adjacent to the first linear part 15*b* in the lateral direction X. The forward connecting part 52 and the return connecting part 53 of the third linear part 17 function as gap closures that fill the gap between the return connecting part 33 of the first linear part 15*a* and the forward connecting part 32 of the first linear part 15*a*.

A part of the second linear part 16 is disposed between the connecting parts 33 and 32 of the first linear parts 15*a* and 15*b* adjacent to each other in the lateral direction X outside the first linear part 15, and is substantially flush with the connecting parts 33 and 32.

The end of the third linear part 17 is disposed between the connecting parts 32 and 33 of the first linear parts 15 adjacent to each other in the lateral direction X outside the second linear part 16, and is substantially flush with the connecting parts 32 and 33.

That is, in the linear parts 15 to 17, the connecting parts 32, 33, 42, 43, 52, and 53 configure flat parts 65 and 65 on front and reverse, respectively.

The first linear part 15 and the second linear part 16 are provided so as not to overlap three-dimensionally. On the other hand, in the third linear part 17, exposed parts exposed from the fiber groups 11 and 12 three-dimensionally intersect with the first linear part 15 and the second linear part 16.

The third linear part 17 straddles the openings of the adjacent annular parts 20 and 20. That is, the upper folded part 50 of the third linear part 17 extends such that the connecting part 57 crosses the connecting parts 32, 42, 43, and 33 and three-dimensionally intersects with the connecting part 32, 42, 43, and 33.

The connecting parts 61 and 61 of the fiber groups 11 and 12 sandwich the flat parts 65 and 65 of the attachment part 10. The connecting part 61 of the first fiber group 11 is in surface contact with the flat part 65 on one side of the attachment part 10. The connecting part 61 of the second fiber group 12 is in surface contact with the flat part 65 on the other side of the attachment part 10. The artificial hair 2 is sewn with a thread or the like at an overlapping part of the connecting part 61 and the flat part 65.

As shown in FIG. 2, the cap member 3 is a covering member that can be attached to the head 200 of the user, and includes a base cap part 70 and a braided (knitted) part 71 in which imitation hair is braided (knitted).

The base cap part 70 is a mesh-like body curved along the head 200.

As shown in FIG. 6, the braided (braided) part 71 is a part where two bundle-shaped fiber bundles are braided (knitted) in two, and includes a plurality of knots of the fiber bundles. As shown in FIG. 2, the braided part 71 is sewn so as to meander on the base cap part 70 and almost entirely cover the base cap part 70.

As shown in FIG. 6, the braided part 71 has a gap between the fiber bundles, and when the braided part 71 is loosened, a gap 72 is formed at a braided location where the fiber bundles are braided.

The gap 72 allows the attachment string 5 to be inserted.

The attachment string 5 is an attachment member for attaching the artificial hair 2 to the cap member 3, and is also a fixing member for fixing the artificial hair 2 to the cap member 3.

The attachment string 5 is string-shaped and is stretchable in the longitudinal direction, and preferably stretchable to a length of 1.1 times or more, preferably stretchable to a length of 1.3 times or more, and still more preferably stretchable to a length of 1.5 times or more with no load applied. The attachment string 5 is stretchable more than the annular parts 20 with no load applied.

An outer shape of a cross section of the attachment string 5 is, for example, circular (or elliptical), and an outer diameter of the attachment string 5 is preferably 0.1 mm or more and 6.0 mm or less.

The outer diameter of the attachment string 5 according to one or more embodiments is about 3 mm, which is larger than an outer diameter of a general sewing thread.

A material of the attachment string 5 is not limited, and may be a natural fiber such as silk thread or cotton thread, or a synthetic fiber such as nylon or polyester.

In one or more of the present embodiments, the attachment string 5 is woven into a mesh shape so as to be stretchable and has a tubular shape.

Next, a treatment method (method for attaching the artificial hair 2) recommended when the artificial hair unit 1 is treated to the user will be described.

First, the artificial hair 2 is attached to the cap member 3 with the attachment string 5.

Figure 7:
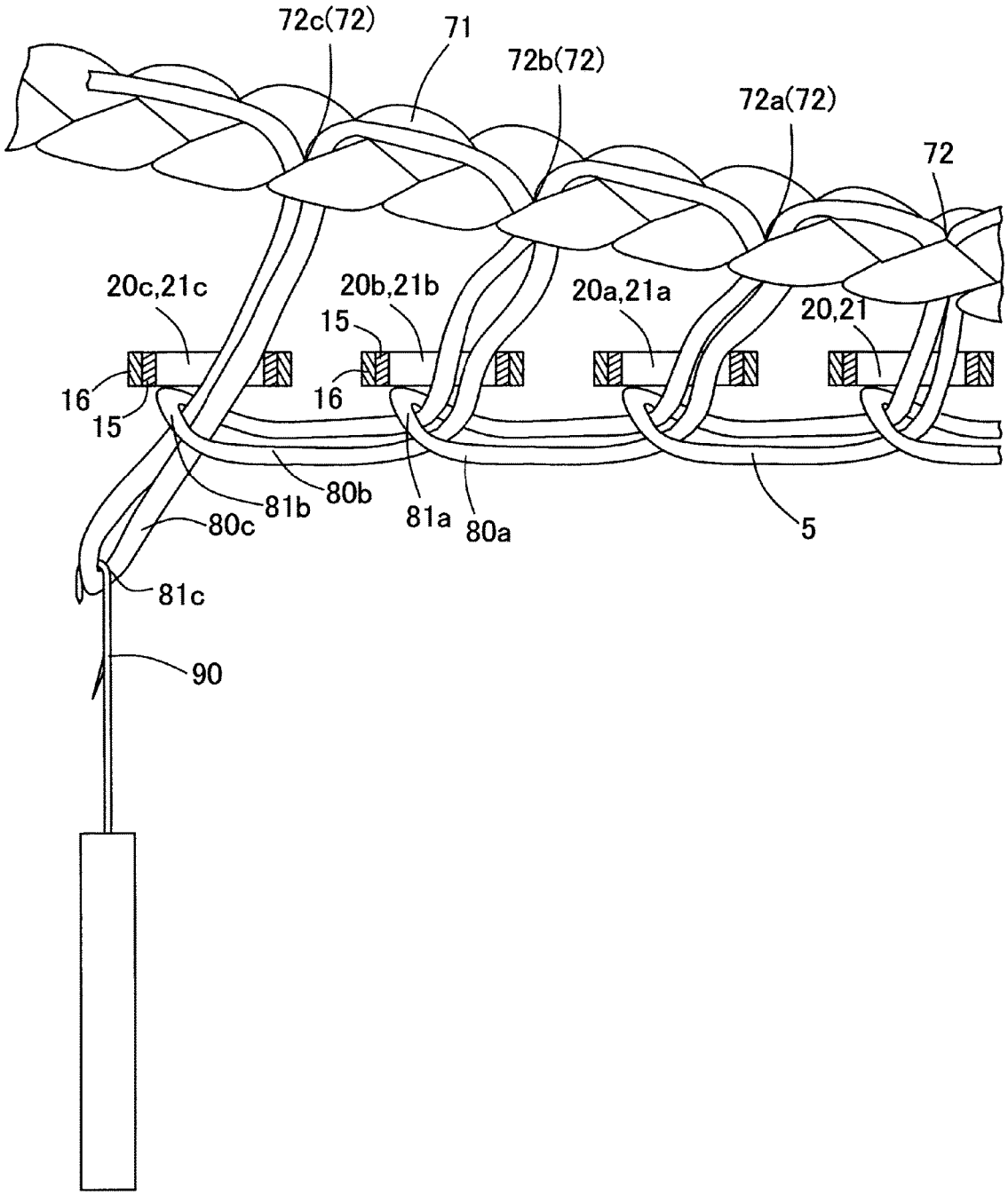
FIG. 7 is a cross-sectional view showing a state in which the artificial hair in FIG. 1 is being attached to the cap member.

Specifically, as shown in FIGS. 6 and 7, the attachment string 5 is disposed along the braided part 71, and an intermediate part 80*a* of the attachment string 5 is hooked by a jig 90 to form a first folded part 81*a*. Then, the first folded part 81*a* is passed through a gap 72*a* of the braided part 71, and further passed through first annular parts 20*a* and 21*a*.

Subsequently, the intermediate part 80*b* of the attachment string 5 is hooked by the jig 90 to form a second folded part 81*b*. The second folded part 81*b* is passed through a gap 72*b* of the braided part 71, and through second annular parts 20*b*, 21*b*, and then through the first folded part 81*a*. That is, the second folded part 81*b* is passed through the first folded part 81*a* outside the second annular parts 20*b* and 21*b* when viewed from the braided part 71.

Subsequently, the intermediate part 80*c* of the attachment string 5 is hooked by the jig 90 to form a third folded part 81*c*. The third folded part 81*c* is passed through a gap 72*c* of the braided part 71, and through third annular parts 20*c* and 21*c*, and then through the second folded part 81*b*. That is, the third folded part 81*c* is passed through the second folded part 81*b* outside the third annular parts 20*c* and 21*c* when viewed from the braided part 71.

This is repeated to attach the artificial hair 2 to the cap member 3 with the attachment string 5, and an end of the attachment string 5 is firmly fixed to the cap member 3.

In the artificial hair unit 1 according to one or more embodiments of the present invention, the plurality of annular parts 20 are provided, and the attachment string 5 can path through the annular parts 20. Thus, the artificial hair unit 1 can be safely attached to the head 200 of the user by passing a thread or string through the annular parts 20 and attaching the thread or string to the cap member 3 without passing a sharp needle.

In the artificial hair 2 according to one or more embodiments of the present invention, the attachment part 10, which includes a braid or weaving, can be easily provided.

In the artificial hair 2 according to one or more embodiments of the present invention, the annular parts 20 are aligned in parallel in the lateral direction X, and the openings face the thickness direction which is a direction intersecting with the lateral direction X. Thus, the attachment string 5 can be passed through each annular part 20 with the artificial hair 2 spread, and the attachment string 5 can be easily passed through each annular part 20.

In the artificial hair 2 according to one or more embodiments of the present invention, the fiber bundle 60 of the first fiber group 11 is located between the fiber bundles 60 of the second fiber group 12 when viewed from a front. It is therefore possible to show an amount of fibers (hair amount) larger than it is.

In the artificial hair 2 according to one or more embodiments of the present invention, the attachment part 10 includes a plurality of linear bodies, and the linear bodies are directly sewn to the fiber groups 11 and 12 to attach the attachment part 10. That is, a base for attaching the attachment part 10 to the fiber groups 11 and 12 is not provided, thereby reducing costs and making a good design.

In the artificial hair 2 according to one or more embodiments of the present invention, the first linear part 15 is sandwiched between the fiber groups 11 and 12 and sewn while meandering, and a part of the first linear part 15 is exposed to outside from between the fiber groups 11 and 12. The exposed part of the first linear part 15 configures each annular part 20 together with the fiber groups 11 and 12. Therefore, each annular part 20 can be configured by one first linear part 15, thereby reducing the costs.

In the artificial hair 2 according to one or more embodiments of the present invention, the second linear part 16 and the third linear part 17 are located between the fiber groups 11 and 12 and function as gap closures that fill the gap between the forward connecting part 32 and the returning connecting part 33. Thus, the second linear part 16 and the third linear part 17 configure the flat part 65 together with the forward connecting part 32 and the return connecting part 33, and the flat part 65 functions as a base for attaching the attachment part 10 to the fiber groups 11 and 12. This facilitates attachment of the fiber groups 11 and 12.

In the artificial hair 2 according to one or more embodiments of the present invention, a part of the second linear part 16 is disposed between the forward connecting part 32 and the return connecting part 33 of the first linear parts 15 adjacent to each other outside the first linear part 15, and is substantially flush with the forward connecting part 32 and the return connecting part 33. This can reduce the thickness of the artificial hair 2 as a whole when the fiber groups 11 and 12 are overlapped with the attachment part 10.

In the artificial hair 2 according to one or more embodiments of the present invention, in the second linear part 16, the exposed part exposed from the fiber groups 11 and 12 is outside the first linear part 15, and the second linear part 16 extends so as to surround each annular part 20 along the first linear part 15. That is, a double structure of the first linear part 15 and the second linear part 16 allows the second linear part 16 to hold the artificial hair 2 with the attachment string 5 by passing the attachment string 5 through the annular parts 20 and 21 even when the first linear part 15 is cut.

In the artificial hair unit 1 according to one or more embodiments of the present invention, in order to attach the artificial hair 2 to the cap member 3, for example, the artificial hair 2 is attached to the cap member 3 and then the cap member 3 is fixed to the head 200 of an operated person, thereby allowing safer treatment.

In the artificial hair unit 1 according to one or more embodiments of the present invention, the attachment string 5 is stretchable in the longitudinal direction, and thus the attachment string 5 extends to prevent an excessive load from being applied to the braided part 71 when the artificial hair 2 is pulled.

In the artificial hair unit 1 according to one or more embodiments of the present invention, the attachment string 5 is untied by releasing an end of the attachment string 5 and pulling the attachment string 5, and thus the artificial hair 2 can be easily attached to and detached from the cap member 3. That is, in the artificial hair unit 1 according to one or more embodiments of the present invention, when it is desired to re-do the sewing, it is possible to easily re-do the sewing as many times as necessary.

In one or more embodiments of the present invention, the artificial hair 2 is attached to the cap member 3 and then the cap member 3 is attached to the head 200, but one or more embodiments of the present invention are not limited thereto. The artificial hair 2 may be attached to the cap member 3 after the cap member 3 is attached to the head 200.

In one or more embodiments of the present invention, the cap member 3 entirely covers the head 200, but one or more embodiments of the present invention are not limited thereto. The cap member 3 may partially cover the head 200.

Figure 8A:
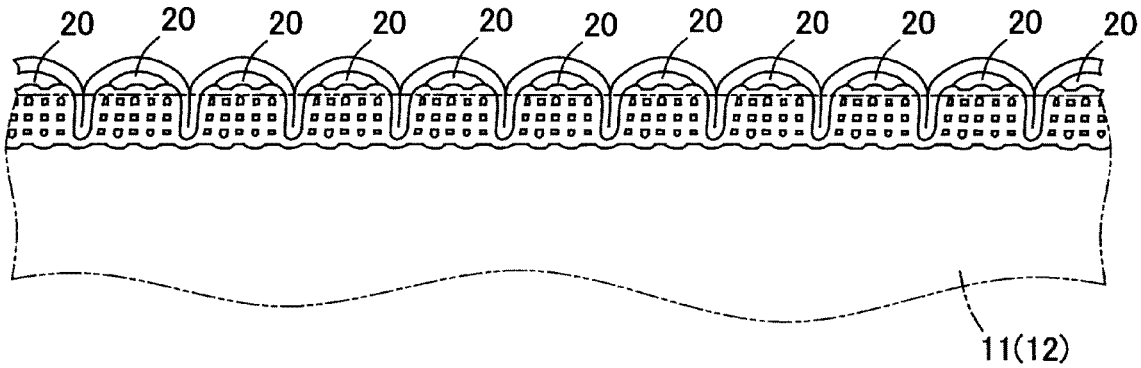
FIGS. 8A to 8C are explanatory views of artificial hair according to one or more embodiments of the present invention, each showing a plan view of different embodiments.
Figure 8B:
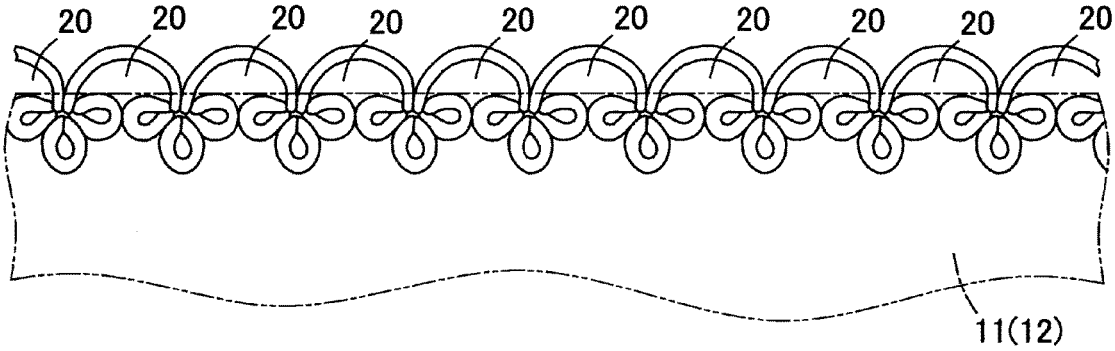
Figure 8C:
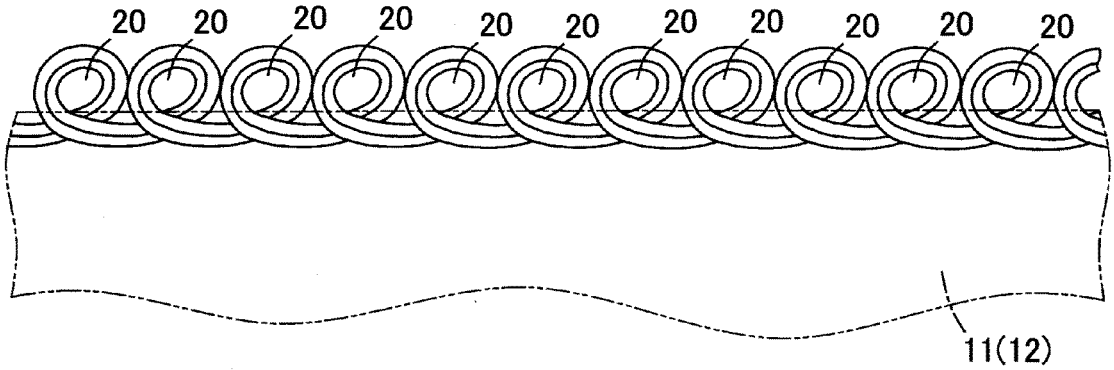

In one or more embodiments of the present invention, a case has been described where the attachment part 10 is a braid or weaving including three types of linear parts 15 to 17, but one or more embodiments of present invention are not limited thereto. As long as the braid or weaving has the annular parts 20, another form of braid or weaving can also be used as the attachment part 10. For example, as shown in FIG. 8A, the attachment part 10 may be a braid or weaving in which the linear part is woven into a mesh shape, and an arch-shaped linear part is provided on an upper part of the braided part to form each annular part 20. For example, as shown in FIG. 8B, the attachment part 10 may be a braid or weaving in which the linear part is woven into a trefoil shape, and an arch-shaped linear part is provided on an upper part of the braided part to form each annular part 20. As shown in FIG. 8C, the attachment part 10 may be a braid or weaving in which a linear part is provided in a one-stroke shape to form each annular part 20.

In one or more embodiments of the present invention, the artificial hair 2 is attached to the cap member 3 and the cap member 3 is fixed to the hair of the head 200 of the user to fix the artificial hair 2 to the head 200 of the user, but one or more embodiments of the present invention are not limited thereto. The artificial hair 2 may be attached directly to the hair of the user.

Although the disclosure has been described with respect to only a limited number of embodiments, those skilled in the art, having benefit of this disclosure, will appreciate that various other embodiments may be devised without departing from the scope of the present invention. Accordingly, the scope of the present invention should be limited only by the attached claims.

EXPLANATION OF REFERENCE SIGNS

1: Artificial hair unit
2: Artificial hair
3: Cap member
5: Attachment string
10: Attachment part
11: First fiber group
12: Second fiber group
15: First linear part
16: Second linear part
17: Third linear part
20,20*a*-20*c*: Annular part
30: Upper folded part
31: Lower folded part
32: Forward connecting part
33: Return connecting part
60: Fiber bundle
61: Connecting part
65: Flat part
70: Base cap part
71: Braided part
72: Gap
80: Intermediate part
81: Folded part
90: Jig
200: Head

The invention claimed is:

1. A hair attachment comprising:

at least two fiber groups spread in a first direction; and an attachment part having a plurality of annular parts, wherein the attachment part extends in the first direction, wherein:

the attachment part includes a flat part, the at least two fiber groups include a connecting part, the flat part is sandwiched between the two fiber groups to contact with the connecting part in surface and is sewn onto the two fiber groups, the annular parts are exposed to an outside from between the two fiber groups, the attachment part includes a first linear part that configures the annular parts, the first linear part includes:

an external folded part that is folded outside the at least two fiber groups;

a forward connecting part directed from between the two fiber groups toward the external folded part; and a return connecting part directed from the external folded part toward between the two fiber groups, the hair attachment includes a gap closure disposed between the at least two fiber groups, the gap closure filling a gap between the forward connecting part and the return connecting part in the first direction, and the gap closure is flush with the forward connecting part and the return connecting part.

2. The hair attachment according to claim 1, wherein the attachment part is a braid or a weaving.

3. The hair attachment according to claim 1, wherein each of the annular parts have an opening, and wherein the opening encloses a circle having a maximum diameter, wherein the maximum diameter is 1.5 mm or more and 2 cm or less.

4. The hair attachment according to claim 1, wherein the annular parts are aligned in parallel to the first direction and have an opening facing a direction different from the first direction.

5. The hair attachment according to claim 1, wherein each of the annular parts include a linear body, and the linear body has an arithmetic mean width of 0.5 mm or more and 3 mm or less.

6. The hair attachment according to claim 1, wherein the plurality of annular parts includes a linear body and is stretchable in an extending direction.

7. The hair attachment according to claim 1, wherein the at least two fiber groups include a first fiber group and a second fiber group, wherein the first fiber group and the second fiber group each have fiber bundles in which a plurality of fibers are bundled, and wherein the fiber bundle of the first fiber group are located between the fiber bundles of the second fiber group in the first direction when viewed from a front.

8. The hair attachment according to claim 1, wherein the attachment part includes a plurality of linear bodies, and wherein the attachment part is attached to the two fiber groups by direct sewing of the plurality of linear bodies onto the two fiber groups.

9. The hair attachment according to claim 1, wherein the first linear part is sandwiched between the two fiber groups and is sewn onto the two fiber groups while meandering, wherein the first linear part has an exposed part that is exposed to an outside from between the two fiber groups, and wherein the exposed part of the first linear part is configured to form a plurality of annular parts together with the two fiber groups.

10. The hair attachment according to claim 9, wherein the first linear part comprises:

an internal folded part that is folded inside the at least two fiber groups;

the forward connecting part directed from the internal folded part toward the external folded part; and the return connecting part directed from the external folded part toward the internal folded part.

11. The hair attachment according to claim 10, comprising a second linear part extending inside and outside the two fiber groups, wherein the second linear part is partially disposed between the forward connecting part and the return connecting part outside the first linear part to be substantially flush with the forward connecting part and the return connecting part.

12. The hair attachment according to claim 9, comprising a second linear part extending inside and outside the two fiber groups, wherein the second linear part includes an exposed part that is exposed from the two fiber groups, the exposed part being outside the first linear part, the exposed part extending so as to surround the annular parts.

13. A hair attachment unit comprising:

a cap member that comprises a knitted part in which imitation hair is knitted, where the cap member is configured to cover a part or all of a head of a user;

the hair attachment according to claim 1; and an attachment string for attaching the hair attachment to the cap member, wherein the attachment string passes through the annular parts and the knitted part, thereby attaching the annular parts to the knitted part, and wherein the attachment string is untied when pulled in the first direction.

14. The hair attachment unit according to claim 13, wherein the attachment string is stretchable in a longitudinal direction.

15. The hair attachment unit according to claim 14, wherein the attachment string is stretchable up to 1.1 times or more with no load applied.

* * * * *